US006178557B1

(12) United States Patent
Bel Monte

(10) Patent No.: US 6,178,557 B1
(45) Date of Patent: Jan. 30, 2001

(54) APPAREL STAIN PROTECTOR

(76) Inventor: Kathryn Bel Monte, 312 Baker Dr., West Palm Beach, FL (US) 33409

( * ) Notice: Under 35 U.S.C. 154(b), the term of this patent shall be extended for 0 days.

(21) Appl. No.: 09/301,738

(22) Filed: Apr. 29, 1999

(51) Int. Cl.[7] ..... A41D 27/16
(52) U.S. Cl. ..... 2/60; 2/53; 36/3 B; 36/71
(58) Field of Search ..... 2/53–58, 60, 455; 36/71, 77 R, 3 B; 602/20

(56) References Cited

U.S. PATENT DOCUMENTS

| | | | | |
|---|---|---|---|---|
| 513,416 | * | 1/1894 | Raphael | 2/53 |
| 560,289 | * | 5/1896 | Warner | 2/53 |
| 2,636,175 | * | 4/1953 | Hoffman, Jr. | 2/55 |
| 2,654,888 | * | 10/1953 | Brightman | 2/56 |
| 2,685,086 | * | 8/1954 | Henry | 2/55 |
| 2,724,382 | * | 11/1955 | Burgio | 36/70 R |
| 2,911,647 | * | 11/1959 | Dixon et al. | 2/53 |
| 3,316,663 | * | 5/1967 | Neu | 36/71 |
| 3,345,643 | * | 10/1967 | Bradley | 2/53 |
| 3,346,878 | * | 10/1967 | Morris | 2/53 |
| 3,588,916 | * | 6/1971 | Glatt | 2/53 |
| 3,727,237 | * | 4/1973 | Glatt | 2/56 |
| 3,885,247 | * | 5/1975 | Kost | 2/55 |
| 4,408,402 | * | 10/1983 | Looney | 36/43 |
| 4,856,111 | * | 8/1989 | Sholes | 2/56 |
| 5,218,056 | * | 6/1993 | Santiyanont et al. | 525/332.6 |
| 5,539,020 | * | 7/1996 | Bracken et al. | 523/212 |
| 5,711,030 | * | 1/1998 | Anderson et al. | 2/60 |

* cited by examiner

*Primary Examiner*—John J. Calvert
*Assistant Examiner*—Gary L. Welch

(57) ABSTRACT

A apparel stain protector for protecting a user's garments from perspiration staining. The apparel stain protector includes an absorbent pad comprises a pair of flexible outer plies and a flexible middle ply interposed between the outer plies, Ideally, the plies are substantially coextensive with one another. The outer plies each comprise a mesh fabric material having a plurality of apertures therethrough. The middle ply comprises a water absorbent fabric material for absorbing moisture and perspiration.

5 Claims, 3 Drawing Sheets

APPAREL STAIN PROTECTOR

BACKGROUND OF THE INVENTION

1. Field of the Invention

The present invention relates to disposable apparel stain protectors and more particularly pertains to a new apparel stain protector for protecting a user's garments and undergarments from perspiration staining.

2. Description of the Prior Art

The use of apparel stain protectors is known in the prior art. More specifically, apparel stain protectors heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,747,162; U.S. Pat. No. 4,545,080; U.S. Pat. No. 2,818,572; U.S. Pat. No. 3,727,237; U.S. Pat. No. 5,042,088; and U.S. Pat. No. Des. 298,081.

While these devices fulfill their respective, particular objectives and requirements, the aforementioned patents do not disclose a new apparel stain protector. The inventive device includes an absorbent pad comprises a pair of flexible outer plies and a flexible middle ply interposed between the outer plies, Ideally, the plies are substantially coextensive with one another. The outer plies each comprise a mesh fabric material having a plurality of apertures therethrough. The middle ply comprises a water absorbent fabric material for absorbing moisture and perspiration.

In these respects, the apparel stain protector according to the present invention substantially departs from the conventional concepts and designs of the prior art, and in so doing provides an apparatus primarily developed for the purpose of protecting a user's garments and undergarments from perspiration staining.

SUMMARY OF THE INVENTION

In view of the foregoing disadvantages inherent in the known types of apparel stain protectors now present in the prior art, the present invention provides a new apparel stain protector construction wherein the same can be utilized for protecting a user's garments from perspiration staining.

The general purpose of the present invention, which will be described subsequently in greater detail, is to provide a new disposable apparel stain protector apparatus and method which has many of the advantages of the apparel stain protectors mentioned heretofore and many novel features that result in a new apparel stain protector which is not anticipated, rendered obvious, suggested, or even implied by any of the prior art apparel stain protectors, either alone or in any combination thereof.

To attain this, the present invention generally comprises an absorbent pad comprises a pair of flexible outer plies and a flexible middle ply interposed between the outer plies, Ideally, the plies are substantially coextensive with one another. The outer plies each comprise a mesh fabric material having a plurality of apertures therethrough. The middle ply comprises a water absorbent fabric material for absorbing moisture and perspiration.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new disposable apparel stain protector apparatus and method which has many of the advantages of the apparel stain protectors mentioned heretofore and many novel features that result in a new apparel stain protector which is not anticipated, rendered obvious, suggested, or even implied by any of the prior art apparel stain protectors, either alone or in any combination thereof.

It is another object of the present invention to provide a new disposable apparel stain protector which may be easily and efficiently manufactured and marketed.

It is a further object of the present disposable invention to provide a new apparel stain protector which is of a durable and reliable construction.

An even further object of the present invention is to provide a new disposable apparel stain protector which is susceptible of a low cost of manufacture with regard to both materials and labor, and which accordingly is then susceptible of low prices of sale to the consuming public, thereby making such apparel stain protector economically available to the buying public.

Still yet another object of the present invention is to provide a new disposable apparel stain protector which provides in the apparatuses and methods of the prior art some of the advantages thereof, while simultaneously overcoming some of the disadvantages normally associated therewith.

Still another object of the present invention is to provide a new disposable apparel stain protector for protecting a user's garments from perspiration staining.

Yet another object of the present invention is to provide a new disposable apparel stain protector which includes an absorbent pad comprises a pair of flexible outer plies and a flexible middle ply interposed between the outer plies. Ideally, the plies are substantially coextensive with one another. The outer plies each comprise a mesh fabric material having a plurality of apertures therethrough. The middle ply comprises a water absorbent fabric material for absorbing moisture and perspiration.

Still yet another object of the present invention is to provide a new disposable apparel stain protector that has embodiments for protecting the collar of a garment, the underarm regions of a garment, and toe region of open toed shoe from various stains including perspiration stains.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

With reference now to the drawings, and in particular to FIGS. 1 through 6 thereof, a new apparel stain protector embodying the principles and concepts of the present invention will be described.

As best illustrated in FIGS. 1 through 6, the apparel stain protector generally comprises an absorbent pad comprises a pair of flexible outer plies and a flexible middle ply interposed between the outer plies, Ideally, the plies are substantially coextensive with one another. The outer plies each comprise a mesh fabric material having a plurality of apertures therethrough. The middle ply comprises a water absorbent fabric material for absorbing moisture and perspiration.

In closer detail, the apparel stain protector system is based on a basic absorbent pad structure having a pair of flexible outer plies 10,11 and a flexible middle ply 12 interposed between the outer plies, Ideally, the plies are substantially coextensive with one another. The outer plies each comprise a mesh fabric material having a plurality of apertures therethrough. The middle ply comprises a water absorbent fabric material such as a cotton batting material.

Figure 1:
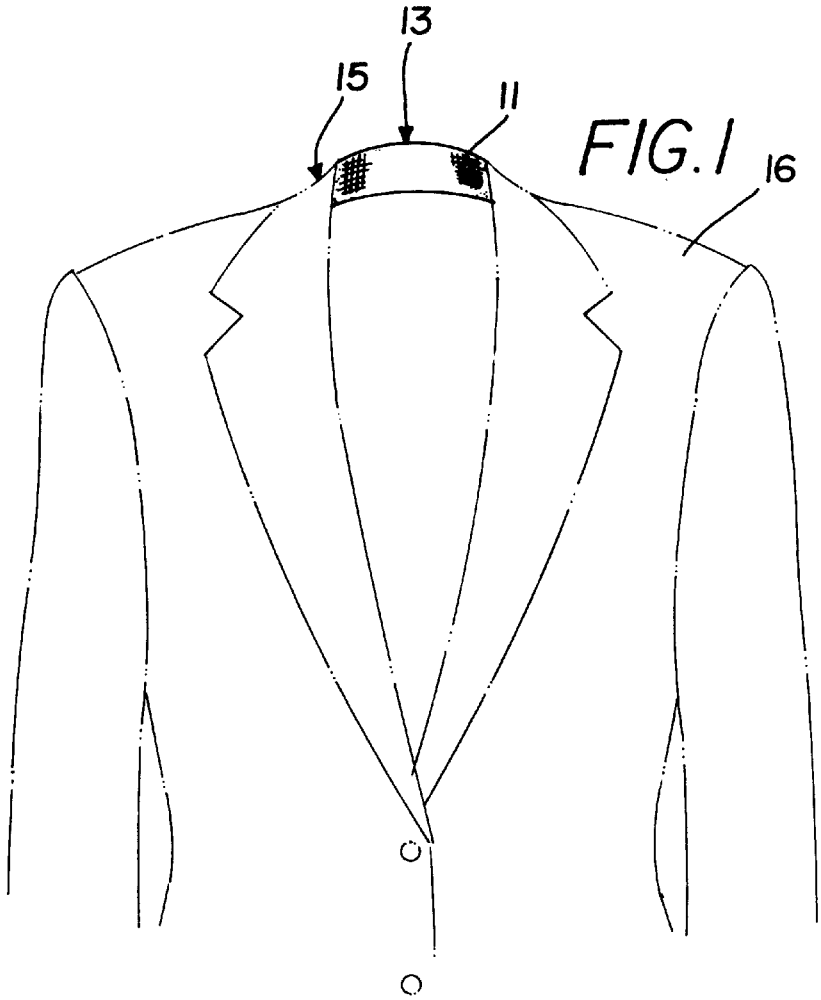
FIG. 1 is a schematic front view of an inner collar absorbent pad on the inner collar of a coat
Figure 2:
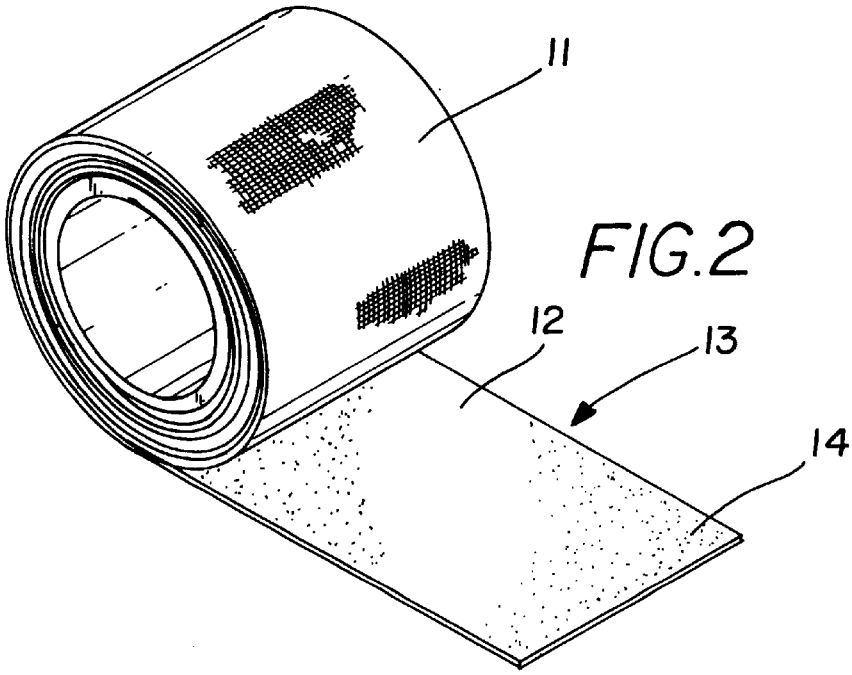
FIG. 2 is a schematic perspective view of the inner collar absorbent pad rolled up into a roll.

With reference to FIGS. 1 and 2, the plurality of absorbent pads includes at least collar absorbent pad 13 having a generally rectangular elongate strip configuration. One of the outer plies of the collar absorbent pad has an adhesive 14 applied substantially coextensively thereon. The adhesive of the collar absorbent pad is adhesively coupled to an inner collar portion 15 of a coat 16, jacket, or shirt for protecting the inner collar portion from perspiration stains.

Figure 3:
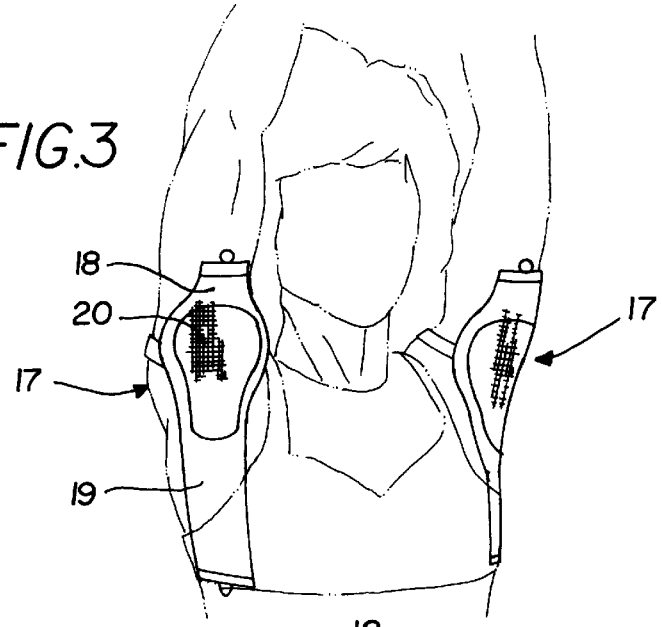
FIG. 3 is a schematic front view of a pair of underarm absorbent pads in use on a user.
Figure 4:
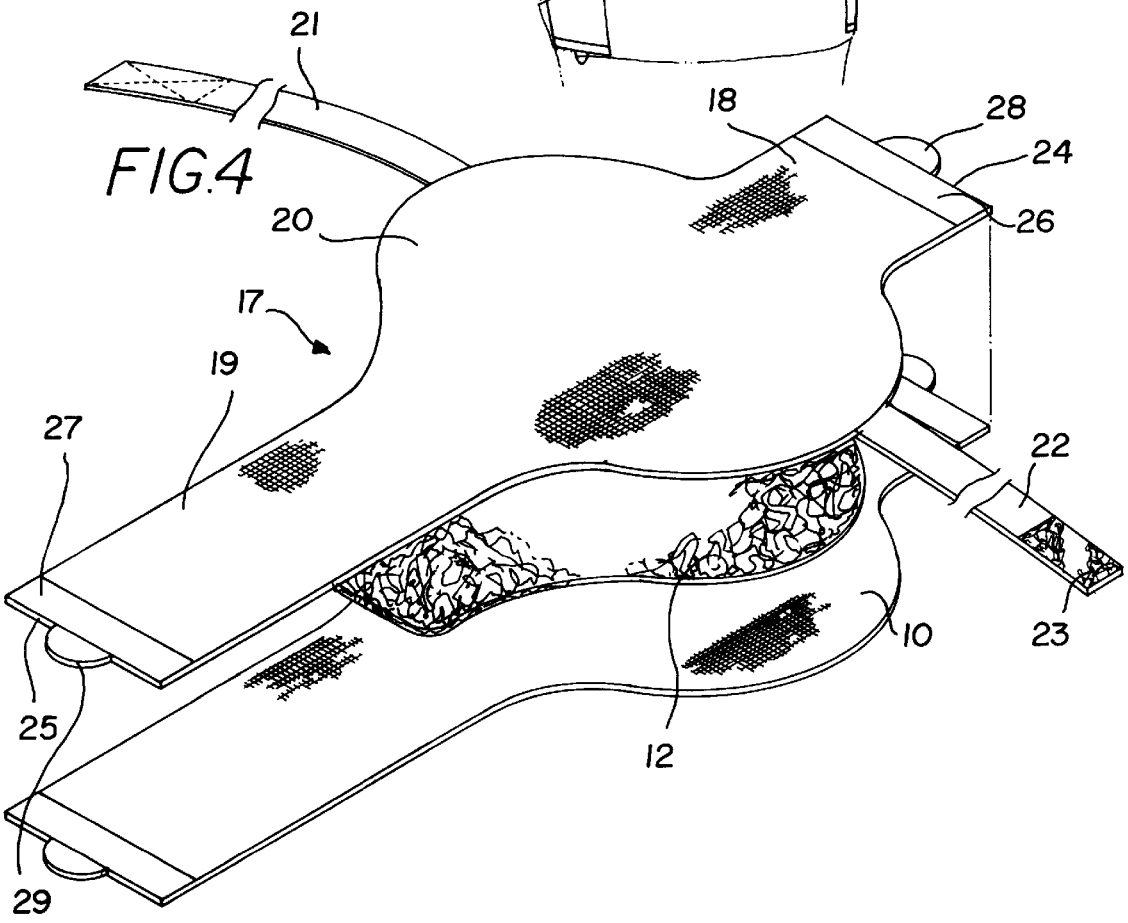
FIG. 4 is a schematic exploded perspective view of the underarm absorbent pad to illustrate the three plies of the absorbent pads.

With reference to FIGS. 3 and 4, the plurality of absorbent pads also includes at least one underarm absorbent pad 17. The underarm absorbent pad has an opposite pair of generally rectangular end regions 18,19, and a generally circular central region 20 interposed between the end regions of the underarm absorbent pad. The central region of the underarm absorbent pad is designed for abutting adjacent an armpit of a user such that one end region of the underarm absorbent pad is extended along an adjacent upper arm of the user and the other end region of the underarm absorbent pad is extended along an adjacent side of the user's torso.

The central region of the underarm absorbent pad has a pair of diametrically opposite shoulder straps 21,22 outwardly extending therefrom generally perpendicular to the end regions of the underarm absorbent pad. The shoulder straps each have a terminal end. In use, the shoulder straps are designed for wrapping around an adjacent shoulder of the user and the terminal ends of the shoulder straps are designed for coupling together to secure the underarm absorbent pad to the armpit of the user. Ideally, a hook and loop fastener 23 detachably couples the terminal ends of the shoulder strap together.

Each of the end regions of the underarm absorbent pad terminates at a free edge 24,25. The free edges of the end regions extend substantially parallel to one another. The underarm absorbent pad has a pair of adhesive strips 26,27 provided on one of the outer layers of the underarm absorbent pad. One of the adhesive strips is positioned along the free edge of one of the end regions and the other of the adhesive strips is positioned along the free edge of the other of the end regions. In use, the adhesive strips is designed for adhesively coupling the underarm absorbent pad to the skin of the user when the one outer layer is abutting the skin of the user.

The free edges of the end regions each preferably have an outwardly extending generally semi-circular tab 28,29. In use, the tabs are designed for grasping with the user's fingers to aid the grip of the user on the underarm absorbent pad when removing the underarm absorbent pad from the armpit of the user.

Figure 6:
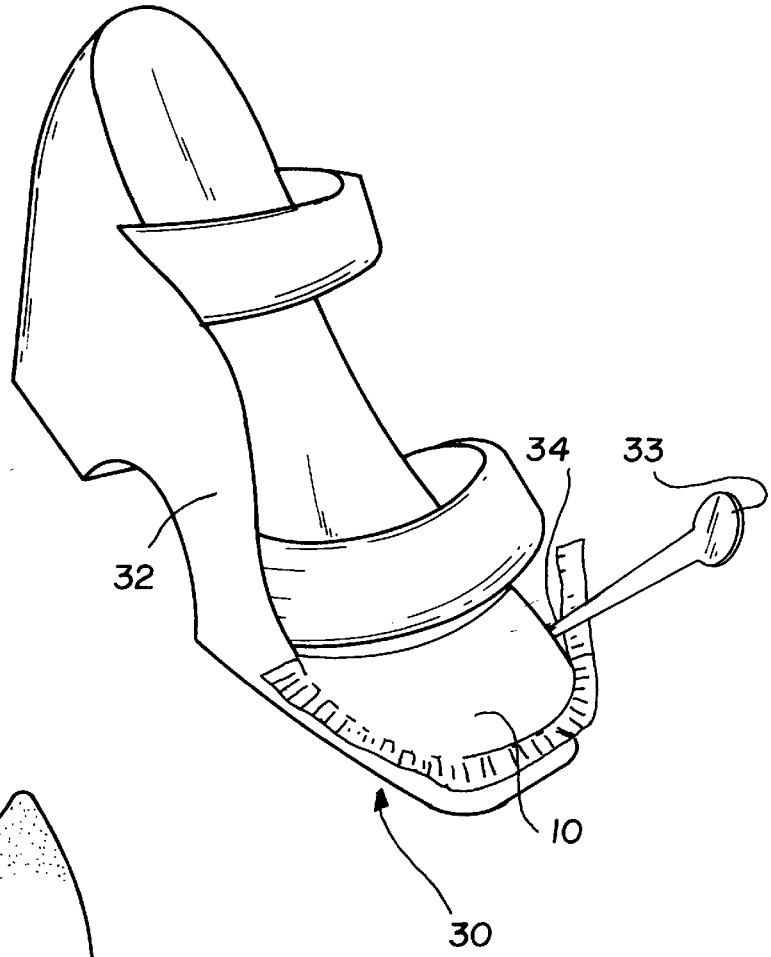
FIG. 6 is a schematic perspective view of the toe absorbent pad attached to the toe region of an open-toed article of footwear.
Figure 5:
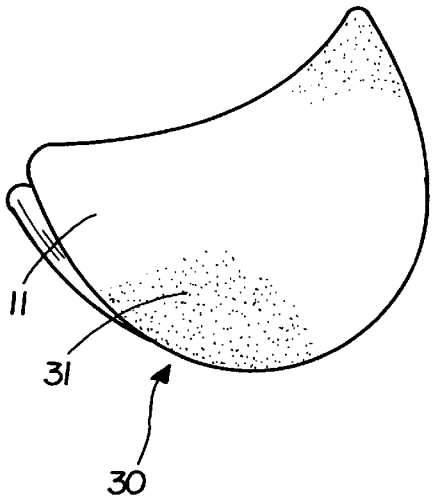
FIG. 5 is a schematic perspective view of the bottom face of a toe absorbent pad.

With reference to FIGS. 5 and 6, the plurality of absorbent pad further includes at least one toe absorbent pad 30 having a generally D-shaped outer perimeter. One of the outer ply of the toe absorbent pad has an adhesive 31 provided substantially coextensively thereon. The adhesive of the toe absorbent pad adhesively couples the one outer ply of the toe absorbent pad to a toe region of an open-toed article of footwear 32 to protective the toe region from staining. In this embodiment, the exposed non-adhesive outer ply of the toe absorbent pad may have a vinyl coating to provide a water proof barrier to this outer ply. Ideally, a cutting tool 33 with a pointed cutting tip 34 may be used to trim the outer perimeter of the toe absorbent pad to conform to the outer contour of the toe region of the open-toed article of footwear.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An apparel stain protector system, comprising:

an absorbent pad comprising a pair of flexible outer plies and a flexible middle ply interposed between said outer plies, wherein said plies are substantially coextensive with one another;

said outer plies each comprising a mesh fabric material having a plurality of apertures therethrough;

said middle ply comprising a water absorbent fabric material;

wherein said absorbent pad comprises an underarm absorbent pad, wherein said underarm absorbent pad has a pair of generally rectangular opposite end regions, and a generally circular central region interposed between said end regions of said underarm absorbent pad, wherein said central region of said underarm absorbent pad is adapted for abutting adjacent an armpit of a user such that one end region of said underarm absorbent pad is extended along an adjacent upper arm of the user, and the other end region of said underarm absorbent pad is extended along an adjacent side of the user's torso;

wherein each of said end regions of said underarm absorbent pad terminates at a free edge, said free edges of said end regions extending substantially parallel to one another, said underarm absorbent pad having a pair of adhesive strips provided on one of said outer layers of said underarm absorbent pad, said adhesive strips being adapted for adhesively coupling said underarm absorbent pad to the skin of the user; and wherein said other end region of said underarm absorbent pad extends along the side of the user's torso to point below an adjacent pectoral muscle of the user for preventing said adhesive strip from being dislodged by movement of the user's skin.

2. The apparel stain protector system of claim 1, wherein said absorbent pad comprises a collar absorbent pad having a generally rectangular elongate strip configuration, one of said outer plies of said collar absorbent pad having an adhesive applied thereon, wherein said adhesive of said collar absorbent pad is adhesively coupled to an inner collar portion of a coat.

3. The apparel stain protector system of claim 1, wherein said central region of said underarm absorbent pad has a pair of diametrically opposite shoulder straps outwardly extending therefrom generally perpendicular to said end regions of said underarm absorbent pad, said shoulder straps being adapted for wrapping around an adjacent shoulder of the user.

4. The apparel stain protector system of claim 1, wherein said absorbent pad comprises a toe absorbent pad having a generally D-shaped outer perimeter, one of said outer ply of said toe absorbent pad having an adhesive provided thereon, said adhesive of said toe absorbent pad adhesively coupling said one outer ply of said toe absorbent pad to a toe region of an open-toed article of footwear.

5. An apparel stain protector system, comprising:

a plurality of absorbent pads each comprising a pair of flexible outer plies and a flexible middle ply interposed between said outer plies, wherein said plies are substantially coextensive with one another;

said outer plies each comprising a mesh fabric material having a plurality of apertures therethrough;

said middle ply comprising a water absorbent fabric material;

said plurality of absorbent pads including at least collar absorbent pad having a generally rectangular elongate strip configuration, one of said outer plies of said collar absorbent pad having an adhesive applied thereon;

said adhesive of said collar absorbent pad being adhesively coupled to an inner collar portion of a coat;

said plurality of absorbent pads including at least one underarm absorbent pad;

said underarm absorbent pad having an opposite pair of generally rectangular end regions, and a generally circular central region interposed between said end regions of said underarm absorbent pad;

said central region of said underarm absorbent pad being adapted for abutting adjacent an armpit of a user such that one end region of said underarm absorbent pad is extended along an adjacent upper arm of the user, and the other end region of said underarm absorbent pad is extended along an adjacent side of the user's torso;

said central region of said underarm absorbent pad having a pair of diametrically opposite shoulder straps outwardly extending therefrom generally perpendicular to said end regions of said underarm absorbent pad;

said shoulder straps each having a terminal end, said shoulder straps being adapted for wrapping around an adjacent shoulder of the user and said terminal ends of said shoulder straps being adapted for coupling together to secure said underarm absorbent pad to the armpit of the user, wherein a hook and loop fastener detachably couples said terminal ends of said shoulder strap together;

each of said end regions of said underarm absorbent pad terminating at a free edge, said free edges of said end regions extending substantially parallel to one another;

said underarm absorbent pad having a pair of adhesive strips provided on one of said outer layers of said underarm absorbent pad, one of said adhesive strips being positioned along said free edge of said end regions and the other of said adhesive strips being positioned along said free edge of the other of said end regions, said adhesive strips being adapted for adhesively coupling said underarm absorbent pad to the skin of the user when said one outer layer is abutting the skin of the user;

wherein said other end region of said underarm absorbent pad extends along the side of the user's torso to point below an adjacent pectoral muscle of the user for preventing said adhesive strip from being dislodged by movement of the user's skin said free edge of edges of said end regions each having an outwardly extending generally semi-circular tab, said tabs being adapted for grasping with the user's fingers to aid the grip of the user on said underarm absorbent pad when removing the underarm absorbent pad from the armpit of the user;

said plurality of absorbent pad including at least one toe absorbent pad having a generally D-shaped outer perimeter;

one of said outer ply of said toe absorbent pad having an adhesive provided thereon;

said adhesive of said toe absorbent pad adhesively coupling said one outer ply of said toe absorbent pad to a toe region of an open-toed article of footwear; and wherein a cutting tool with a pointed cutting tip may be used to trim the outer perimeter of the toe absorbent pad to conform to the outer contour of the toe region of the open-toed article of footwear.

* * * * *